US008094026B1

(12) United States Patent
Green

(10) Patent No.: US 8,094,026 B1
(45) Date of Patent: Jan. 10, 2012

(54) ORGANIZED RETAIL CRIME DETECTION SECURITY SYSTEM AND METHOD

(76) Inventor: Robert M Green, Phoenix, AZ (US)

( * ) Notice: Subject to any disclaimer, the term of this patent is extended or adjusted under 35 U.S.C. 154(b) by 0 days.

(21) Appl. No.: 13/099,309

(22) Filed: May 2, 2011

(51) Int. Cl.
*G08B 13/14* (2006.01)

(52) U.S. Cl. ..... 340/572.1; 340/5.8; 340/5.81; 340/568.1; 340/572.2; 340/572.3; 340/572.4; 348/143; 348/150; 235/375; 235/376; 235/377; 235/385; 235/384

(58) Field of Classification Search ..... 340/5.1, 340/5.81, 568.1, 572.1–572.9; 235/375–385; 348/150, 143; 705/15, 22, 28
See application file for complete search history.

(56) References Cited

U.S. PATENT DOCUMENTS

| | | | |
|---|---|---|---|
| 5,874,896 | A | 2/1999 | Lowe et al. |
| 6,385,772 | B1 | 5/2002 | Courtney |
| 6,520,544 | B1 | 2/2003 | Mitchell |
| 6,608,563 | B2 | 8/2003 | Weston et al. |
| 6,661,340 | B1 | 12/2003 | Saylor et al. |
| 6,791,603 | B2 | 9/2004 | Lazo et al. |
| 6,926,202 | B2 | 8/2005 | Noonan |
| 6,998,987 | B2 | 2/2006 | Lin |
| 7,005,988 | B2 | 2/2006 | Mathewson, II et al. |
| 7,015,806 | B2 | 3/2006 | Naidoo |
| 7,049,965 | B2 | 5/2006 | Kelliher |
| 7,123,146 | B1 | 10/2006 | Holzman |
| 7,205,882 | B2 | 4/2007 | Libin |
| 7,304,574 | B2 | 12/2007 | Romer et al. |
| 7,518,506 | B2 | 4/2009 | Lee et al. |
| 7,530,489 | B2 | 5/2009 | Stockton |
| 7,531,007 | B2 | 5/2009 | Sharma |
| 7,616,091 | B2 | 11/2009 | Libin |
| 7,619,525 | B2 | 11/2009 | Kwan |
| 7,656,858 | B2 | 2/2010 | Campero et al. |
| 7,671,729 | B2 | 3/2010 | Hershkovitz et al. |
| 7,672,872 | B2 | 3/2010 | Shanton |
| 7,724,131 | B2 | 5/2010 | Chen |
| 7,750,812 | B2 | 7/2010 | Campero |
| 7,761,347 | B2 | 7/2010 | Fujisawa et al. |
| 7,796,037 | B2 | 9/2010 | Bauchot et al. |
| 7,825,793 | B1 | 11/2010 | Spillman et al. |
| 7,840,515 | B2 | 11/2010 | Ozdemir et al. |
| 7,859,403 | B2 | 12/2010 | Tampke |
| 7,889,068 | B2 | 2/2011 | Connell, II et al. |

(Continued)

FOREIGN PATENT DOCUMENTS

CN 101256702 A 9/2008

(Continued)

OTHER PUBLICATIONS

Lee,James, "Loss Prevention aat Canada's Largest Food Producer", Loss Prevention Magazine, Jan./Feb. 2010, p. 32, Canada.

(Continued)

*Primary Examiner* — George Bugg
*Assistant Examiner* — Qjiako Nwugo

(57) ABSTRACT

A method for using electronic product identification devices to track the purchase or theft of any multiple merchandise items in a food store or other retail shopping store environment, to determine if a large quantity of items are in the process of being stolen, to activate an alarm condition in a surveillance camera system, alert store security, and send tag information (list of stolen contents thereof) and a video clip file or URL of a web site link to view a video file to store security using remote mobile devices, and to law enforcement if desired.

16 Claims, 5 Drawing Sheets

U.S. PATENT DOCUMENTS

| | | | | |
|---|---|---|---|---|
| 7,911,341 | B2 | 3/2011 | Raji et al. | |
| 2003/0216969 | A1* | 11/2003 | Bauer et al. | 705/22 |
| 2005/0073416 | A1 | 4/2005 | Mathewson, II et al. | |
| 2006/0163350 | A1 | 7/2006 | Melton et al. | |
| 2006/0187042 | A1 | 8/2006 | Romer et al. | |
| 2007/0103303 | A1 | 5/2007 | Shoarinejad | |
| 2009/0045955 | A1 | 2/2009 | Ulrich | |
| 2009/0077167 | A1 | 3/2009 | Baum et al. | |
| 2009/0077624 | A1 | 3/2009 | Baum et al. | |
| 2009/0237232 | A1 | 9/2009 | Connell, II et al. | |
| 2009/0261967 | A1 | 10/2009 | Chen | |
| 2009/0322537 | A1 | 12/2009 | Tapp et al. | |
| 2010/0019905 | A1 | 1/2010 | Boddie et al. | |
| 2010/0097221 | A1 | 4/2010 | Kreiner et al. | |
| 2010/0099461 | A1 | 4/2010 | Rahfaldt et al. | |
| 2010/0148966 | A1 | 6/2010 | Vuppala et al. | |
| 2010/0245582 | A1 | 9/2010 | Harel | |
| 2010/0251391 | A1 | 9/2010 | Adrangi | |
| 2010/0315508 | A1 | 12/2010 | Lee et al. | |
| 2011/0057787 | A1 | 3/2011 | Wu et al. | |
| 2011/0072132 | A1 | 3/2011 | Shafer et al. | |
| 2011/0115914 | A1* | 5/2011 | Bailey et al. | 348/150 |

FOREIGN PATENT DOCUMENTS

| | | | |
|---|---|---|---|
| EP | 1533768 | B1 | 10/2004 |
| EP | 1873705 | A1 | 1/2008 |
| GB | 2355876 | A | 5/2001 |
| JP | 2005-250902 | | 9/2005 |
| JP | 2006-338467 | | 12/2006 |
| JP | 2008-203974 | | 2/2007 |
| JP | 2007-158533 | | 6/2007 |
| JP | 2007-221191 | | 8/2007 |
| JP | 2008-015577 | | 1/2008 |
| JP | 2008-294921 | | 12/2008 |
| JP | 2009-070085 | | 4/2009 |
| JP | 2009-093520 | | 4/2009 |
| JP | 2009-157849 | | 7/2009 |
| JP | 2009-159648 | | 7/2009 |
| JP | 2009-217374 | | 9/2009 |
| JP | 2010-055645 | | 3/2010 |
| JP | 2010-154134 | | 7/2010 |
| WO | WO/00/67221 | | 12/2000 |
| WO | WO/03/067538 | | 1/2003 |
| WO | WO/03/047258 | | 6/2003 |
| WO | WO/2006/020258 | | 4/2005 |
| WO | WO/2008/033954 | A2 | 3/2008 |
| WO | WO/2008/056320 | A1 | 5/2008 |
| WO | WO/2008/125621 | | 10/2008 |
| WO | WO/2008/157113 | | 12/2008 |
| WO | WO/2009/001408 | | 12/2008 |
| WO | WO/2009/081303 | | 7/2009 |
| WO | WO/2011/028237 | | 3/2011 |
| WO | WO/2011/038398 | | 9/2011 |

OTHER PUBLICATIONS

Unknown, "Organized Retail Crime", Wikepedia, The Free Encyclopedia, Aug. 2008, USA.

Thuermer, Karen E., "Retailers Organize Against Crime", Security Management, Jul. 2007, USA.

Talamo, John, "Organized Retail Crime—Executing the ORC Strategy", LP Magazine, Mar./Apr. 2011, USA.

FBI, FBI Partners with Retailers to Fight Organized Retail Theft, FBI National Press Release, Apr. 5, 2007, Washington, D.C., USA.

Winter, Elaine Roxane, "eBay, FBI Team to Fight Organized Retail Crime", San Jose Business Journal, Mar. 22, 2010, USA.

Kohl, Geoff, "Talking Retail Security and Loss Prevention at ISC West", Securityinfowatch.com, Feb. 6, 2009, USA.

Unknown, "Flash Mobs: An Increasingly Common Strategy for Organized Retail Crime?", Security Director News, Apr. 14, 2011, USA.

Palmer, Walter E., "Organized Retail Crime: Assessing the Risk and Developing Effective Strategies", ASIS International, 2009, USA.

Finklea, Kristen,"Organized Retail Crime", Congressional Research Service, Jan. 6, 2011, USA.

* cited by examiner

ORGANIZED RETAIL CRIME DETECTION SECURITY SYSTEM AND METHOD

CROSS-REFERENCE TO RELATED APPLICATIONS

Not applicable

RELATED REFERENCES CITED

Related U.S. Patent Documents

| | | |
|---|---|---|
| 5,874,896 | Feb. 23, 1999 | Lowe; Peter R. et al. |
| 6,385,772 | May 7, 2002 | Courtney; Jonathan D. |
| 6,520,544 | Feb. 18, 2003 | Mitchell; Nancy G. |
| 6,608,563 | Aug. 19, 2003 | Weston; Denise Chapman, et al |
| 6,661,340 | Dec. 9, 2003 | Saylor, Michael J., et al. |
| 6,791,603 | Sep. 14, 2004 | Lazo, Philip A.; et al. |
| 6,926,202 | Aug. 9, 2005 | Noonan; William |
| 6,998,987 | Feb. 14, 2006 | Lin; Yun-Ting |
| 7,005,988 | Feb. 28, 2006 | Mathewson, II; James M., et al |
| 7,015,806 | Mar. 21, 2006 | Naidoo; Surendra N. |
| 7,049,965 | May 23, 2006 | Kelliher; Timothy Patrick |
| 7,123,146 | Oct. 17, 2006 | Holzman; Thomas G. |
| 7,205,882 | Apr. 17, 2007 | Libin, Phil |
| 7,304,574 | Dec. 4, 2007 | Romer; Kevin, et al. |
| 7,518,506 | Apr. 14, 2009 | Lee; Albert, et al. |
| 7,530,489 | May 12, 2009 | Stockton; Marcia L. |
| 7,531,007 | May 12, 2009 | Sharma; Bettadapura Srinath |
| 7,616,091 | Nov. 10, 2009 | Libin, Phil |
| 7,619,525 | Nov. 17, 2009 | Kwan; Derek |
| 7,671,729 | Mar. 10, 2010 | Hershkovitz; Shmuel, et al. |
| 7,724,131 | May 25, 2010 | Chen; Hong-Jyh |
| 7,761,347 | Jul. 20, 2010 | Fujisawa; Hiromichi, et al |
| 7,796,037 | Sep. 14, 2010 | Bauchot; Frederic, et al |
| 7,825,793 | Nov. 2, 2003 | Spillman; Vance P., et al. |
| 7,840,515 | Nov. 23, 2010 | Ozdemir; Hasan Timucin, et al |
| 7,859,403 | Dec. 28, 2010 | Tampke; Michael S. |
| 7,889,068 | Feb. 15, 2011 | Connell, II; Jonathan H. , et al. |
| 7,911,341 | Mar. 22, 2011 | Raji; Reza, et al. |
| 7,656,858 | Feb. 2, 2010 | Campero; Richard J., et al |
| 7,672,872 | Mar. 2, 2010 | Shanton; Kenneth |
| 7,750,812 | Jul. 6, 2010 | Campero; Richard J. |
| 2005/0,073,416 | Apr. 7, 2005 | Mathewson, James M. II; et al. |
| 2006/0,163,350 | Jul. 27, 2006 | Melton; Michael N.; et al |
| 2006/018,7042 | Aug. 24, 2006 | Romer; Kevin; et al. |
| 2007/0,103,303 | May 10, 2007 | Shoarinejad; Kambiz |
| 2009/0,045,955 | Feb. 19, 2009 | Ulrich; Richard |
| 2009/0,077,167 | Mar. 19, 2009 | Baum; Marc; et al. |
| 2009/0,077,624 | Mar. 19, 2009 | Baum; Marc; et al. |
| 2009/0,237,232 | Sep. 24, 2009 | Connell II; Jonathan H.; et al |
| 2009/0,261,967 | Oct. 22, 2009 | Chen; Hong-Jyh |
| 2009/0,322,537 | Dec. 31, 2009 | Tapp; Hollis M.; et al. |
| 2010/0,019,905 | Jan. 28, 2010 | Boddie; John Bennett ; et al. |
| 2010/0,097,221 | Apr. 22, 2010 | Kreiner; Barrett; et al. |
| 2010/0,099,461 | Apr. 22, 2010 | Rahfaldt; James; et al |
| 2010/0,148,966 | Jun. 17, 2010 | Vuppala; Sunil Kumar; et al. |
| 2010/0,245,582 | Sep. 20, 2010 | Harel; Jean Claude |
| 2010/0,251,391 | Sep. 30, 2010 | Adrangi; Farid |
| 2010/0,315,508 | Dec. 16, 2010 | Lee; Hou-Hsien; et al. |
| 2011/0,057,787 | Mar. 10, 2011 | Wu; Chien-Huang; et al. |
| 2011/0,072,132 | Mar. 24, 2011 | Shafer; Gary Mark; et al. |

RELATED FOREIGN REFERENCES CITED

| European Patent Office (EPO Worldwide) | | |
|---|---|---|
| CA2496245 (Al) | Aug. 11, 2005 | SALCEDO DAVID M [US]; et al |
| CN101256702 (A) | Sep. 3, 2008 | YANGDE LI [CN] |
| EP1873705 (Al) | Jan. 2, 2008 | CLEMENT JEAN-YVES [FR]; et al |
| GB2355876 (A) | May 2, 2001 | EVANS RICHARD J., [GB]; et al |
| W02008033954 (A2) | Mar. 20, 2008 | HARWELL JANIS [US] |
| W02008056320 (Al) | May 15, 2008 | WINSON DAVID MILES [ZA] |
| EP1533768 (Bl) | Oct. 25, 2004 | Sacedo, David.; et al |

-continued

| Japan Patent Office (JPO) Patent and Utility Model | | |
|---|---|---|
| 2005-250902 | Sep. 15, 2005 | MATSUZAKI TAKASHI |
| 2006-338467 | Dec. 14, 2006 | USAMI RYOSUKE |
| 2007-158533 | Jun. 21, 2007 | HIKINO SHIN; et al |
| 2007-221191 | Aug. 30, 2007 | KUREYAMA FUMIKO; et al |
| 2008-015577 | Jan. 24, 2008 | YONETANI AKINORI; et al |
| 2008-203974 | Feb. 16, 2007 | TAKAHASHI KIYOYOSHI |
| 2008-294921 | Dec. 4, 2008 | TANIGAWA TOMOHIKO |
| 2009-070085 | Apr. 2, 2009 | KOKURYO KAZUTO |
| 2009-093520 | Apr. 30, 2009 | AIZAWA KATSURA; et al |
| 2009-157849 | Jul. 16, 2009 | WATABE TETSUO |
| 2009-159648 | Jul. 16, 2009 | LAZO PHILIP A; et al |
| 2009-217374 | Sep. 24, 2009 | KOBAYASHI TAKESHI |
| 2010-055645 | Mar. 1, 2010 | FALUN DAVID B; et al |
| 2010-154134 | Jul. 8, 2010 | BABA KENJI; et al |
| World Intellectual Property Organization (WIPO) | | |
| WO/2011/028237 | Mar. 10, 2011 | HO, Wing Kei; et al |
| WO/2011/038398 | Sep. 28, 2010 | MERCIER, Michael; et al. |
| Patentscope International and National Collections (Applications) | | |
| WO/2009/081303 | Jul. 2, 2009 | ALSAFADI, Yasser |
| WO/2000/067221 | Dec. 4, 2000 | GHAFFARI, Touraj; et al |
| WO/2008/125621 | Oct. 23, 2008 | FALKENBERG, Verner; et al |
| WO/2008/157113 | Dec. 24, 2008 | GILLARD, John, P; et al |
| WO/2006/020528 | Apr. 5, 2005 | Salcedo, David M; et al |
| WO/2009/001408 | Dec. 31, 2008 | OKAMASU TAKAYUKI ; et al |
| WO/2003/047258 | Jun. 5, 2003 | JAKOPIN, David, A. et al. |
| WO/2003/067538 | Jan. 31, 2003 | CLIFFORD, Harold C., et al. |
| WO/2006/020528 | Apr. 5, 2005 | Salcedo, David M.; et al. |

OTHER REFERENCES

Non Patent Literature

Lee, James, "Loss Prevention at Canada's Largest Food Producer". Loss Prevention Magazine, January/February 2010, p. 32.

Unknown, "Organized Retail Crime", Wikepedia, The Free Encyclopedia", August, 2008.

Thuermer, Karen E., "Retailers Organize Against Crime", Security Management, July, 2007.

Talamo, John, "Organized Retail Crime—Executing the ORC Strategy", LP Magazine, March/April, 2011.

Unknown, "FBI Partners with Retailers to Fight Organized Retail Theft", FBI National Press Release, Washington D.C., Apr. 5, 2007.

Winter, Elaine Roxane, "eBay, FBI Team to Fight Organized Retail Crime", San Jose Business Journal, Mar. 22, 2010.

Kohl, Geoff, "Talking Retail Security and Loss Prevention at ISC West", Securityinfowatch.com, Feb. 6, 2009.

Unknown, "Flash Mobs: An Increasingly Common Strategy for Organized Retail Crime?", Security Director News, Apr. 14, 2011.

Palmer, Walter E., "Organized Retail Crime: Assessing the Risk and Developing Effective Strategies", ASIS International, 2009

Finklea, Kristen, "Organized Retail Crime", Congressional Research Service, Jan. 6, 2011.

STATEMENT REGARDING FEDERALLY SPONSORED RESEARCH OR DEVELOPMENT

Not Applicable

BACKGROUND OF THE INVENTION

1. Field of Invention

The present invention relates to a system for providing technology in organized retail theft in a store at the high theft areas, to detect a theft when a large quantity of items are stolen. This invention uses RFID technology and integrates with camera and video surveillance systems to detect a theft in progress and trigger an alarm on the surveillance systems for immediate identification of theft, prior to the items being taken out of the store. A common problem with any retail security system using EAS or RFID technology is that alarms are set at the store exit, and once the items are taken out the exit, store security or other personnel cannot follow the perpetrator, make an arrest, or get the stolen items returned. This system is meant to address early detection of a theft such that security personnel can be informed prior to the perpetrator getting to the store exit.

2. Background

Various embodiments of the present invention relate generally to theft deterrent technology and, more particularly, relate to triggering one or more alarms.

Retailers and business owners can suffer substantial financial losses as a result of retail theft. It is becoming increasingly common for shoplifters and thieves to implement organized and coordinated plans involving multiple individuals to steal large amounts of high priced goods from retail and other establishments.

Organized retail theft or organized retail crime differs from typical retail theft in the amount of similar items stolen at one time, which makes the value of one theft much higher than a typical casual theft of one item, and is typically defined by:

1. Theft from a retail establishment in quantities that would not normally be used for personal consumption
2. Reselling large quantities of stolen items to be re-entered into the marketplace
3. Revealing, concealing, transporting, or disposing of stolen items in quantities not normally used for personal consumption
4. Coordinating, organizing, or recruiting to commit the above offenses While there have been security systems in use in retail stores for many years, typically EAS (Electronic Asset Surveillance) systems and more recently the use of RFID technology, no system has specifically addressed the problem and unique challenges of organized retail theft.

It has been proposed to place a RFID tag on or in any desired high theft general merchandise item in a store, typically those items that are of a relatively high cost and have a high rate of theft in such store. Many items sold in stores such as grocery stores, pharmacies, and other retail stores have RFID tags, and many do not.

The present disclosure embodies a number of aspects that can be implemented separately from or in combination with each other. An RFID tag can be placed on any item that has not had an RFID tag affixed by the manufacturer. An RFID reader can detect the RFID tag via short range frequency by placement of the RFID reader and/or RFID antenna, An RFID reader can detect the RFID tag via short range frequency by placement of the RFID reader at store aisles, endcaps, or zones, thus providing a positive reading of the RFID tag if multiple numbers of the same item are taken at one time, then such items are presumed to be stolen as it is detected shelf, aisle, end cap, or zone.

Using the RFID signal, the RFID reader will signal the camera surveillance system with an alarm that will activate the camera alarm system and alerting security that a theft has occurred.

One principal target of this invention is grocery or other retail stores where thefts of high value general merchandise items are commonly stolen. This invention provides both deterrence to theft and an increased rate of identification and apprehension of perpetrators.

While the preferred embodiments of the invention have been described above, it will be recognized and understood that various modifications may be made therein and the appended claims are intended to cover all such modifications that may fall within the spirit and scope of the invention.

DEFINITION OF TERMS

The following term definitions are provided to assist in conveying an understanding of the various exemplary embodiments and features disclosed herein.

Organized Retail Crime, Organized Retail Theft

Organized retail crime refers to professional shoplifting, cargo theft, retail crime rings and other organized crime occurring in retail environments. One person acting alone is not considered an example of organized retail crime. The FBI has estimated that the losses attributed to organized retail crime could reach as much as $30 billion a year. These criminals move from store to store and even city to city. Working in teams, some create distractions while others steal everything from infant formula to DVDs. Often, they are stocking up on specified items at the request of the organized crime leader.

RFID

Radio-frequency identification (RFID) is a technology that uses communication via radio waves to exchange data between a reader and an electronic tag attached to an object, for the purpose of identification and tracking Fixed RFID: Reader reads tags in a stationary position. These fixed readers are set up specific interrogation zones and create a "bubble" of RF energy that can be tightly controlled if the physics is well engineered. This allows a very definitive reading area for when tags go in and out of the interrogation zone.

Mobile RFID: Reader is mobile when the reader reads tags. Mobile readers include handhelds, carts and vehicle mounted RFID readers.

3 Types of RFID Tags

Passive RFID tags: Have no power source and require an external electromagnetic field to initiate a signal transmission. Typically they get powered by the RF energy that the readers transmit. This type of tags typically store between 32 and 128 bits of data and are Read-Only.

Active RFID tags: Contain a battery and can transmit signals once an external source ('Interrogator') has be successfully identified. It can store up to 1 MB of data and are rewritable. Battery assisted passive (BAP) RFID tags: Require an external source to wake up but have significant higher forward link capability providing greater range.

RFID Tags Range & Frequency

Lower-frequency systems are less expensive: higher-frequency systems offer increased range.

Low-Frequency (LF) 125 to 134 KHz band

High-Frequency (HF) 13.56 MHz

Ultra High-Frequency (UHF) 433 MHZ and 860 to 956 MHz band

Microwave-Frequency 2.45 to 5.8 GHz band

The range will depend on the type of frequencies used.

SMS

Short Message Service (SMS) is the text communication service component of phone, web, or mobile communication systems, using standardized communications protocols that allow the exchange of short text messages between fixed line or mobile phone devices

MMS

Multimedia Messaging Service, or MMS, is a standard way to send messages that include multimedia content to and from mobile phones. It extends the core SMS, MMS, RSS, IM, PAGING, OR PRE-RECORDED VOICE CALL (Short Message Service) capability that allowed exchange of text messages only up to 160 characters in length.

PDA

A personal digital assistant (PDA), also known as a palmtop computer, or personal data assistant, is a mobile device that functions as a personal information manager. Current PDAs often have the ability to connect to the Internet. A PDA has an electronic visual display, enabling it to include a web browser, but some newer models also have audio capabilities, enabling them to be used as mobile phones or portable media players. Many PDAs can access the Internet, intranets or extranets via Wi-Fi or Wireless Wide Area Networks.

SNMP

Simple Network Management Protocol (SNMP) is an Internet-standard protocol for managing devices on IP networks. Devices that typically support SNMP include routers, switches, servers, workstations, printers, modem racks, and more. It is used mostly in network management systems to monitor network-attached devices for conditions that warrant administrative attention. SNMP is a component of the Internet Protocol Suite as defined by the Internet Engineering Task Force (IETF). It consists of a set of standards for network management, including an application protocol, a database schema, and a set of data objects

URL

In computing, a Uniform Resource Locator (URL) is a Uniform Resource Identifier (URI) that specifies where an identified resource is available and the mechanism for retrieving it. In popular usage and in many technical documents and verbal discussions it is often incorrectly used as a synonym for URI.[1] The best-known example of the use of URLs is for the addresses of web pages on the World Wide Web, such as http://www.example.com/.

Smartphone

A smartphone is a mobile phone that offers more advanced computing ability and connectivity than a contemporary feature phone. Smartphones and feature phones may be thought of as handheld computers integrated with a mobile telephone, but while most feature phones are able to run applications based on platforms such as Java ME, a smartphone usually allows the user to install and run more advanced applications. Smartphones run complete operating system software providing a platform for application developers. Thus, they combine the functions of a camera phone and a personal digital assistant (PDA).

RTSP or Streaming Media

Streaming media is multimedia that is constantly received by and presented to an end-user while being delivered by a streaming provider. The name refers to the delivery method of the medium rather than to the medium itself. The distinction is usually applied to media that are distributed over telecommunications networks, as most other delivery systems are either inherently streaming (e.g., radio, television) or inherently non-streaming (e.g., books, video cassettes, audio CDs). The verb 'to stream' is also derived from this term, meaning to deliver media in this manner. Internet television is a commonly streamed medium.

Live streaming, more specifically, means taking the media and broadcasting it live over the Internet. The process involves a camera for the media, an encoder to digitize the content, a media publisher where the streams are made available to potential end-users and a content delivery network to distribute and deliver the content. The media can then be viewed by end-users live.

RSS (Most Commonly Expanded as Really Simple Syndication)

RSS is a family of web feed formats used to publish frequently updated works—such as blog entries, news headlines, audio, and video—in a standardized format. An RSS document (which is called a "feed", "web feed", or "channel") includes full or summarized text, plus metadata such as publishing dates and authorship. Web feeds benefit publishers by letting them syndicate content automatically. They benefit readers who want to subscribe to timely updates from favored websites or to aggregate feeds from many sites into one place. RSS feeds can be read using software called an "RSS reader", "feed reader", or "aggregator", which can be web-based, desktop-based, or mobile-device-based. A standardized XML file format allows the information to be published once and viewed by many different programs. The user subscribes to a feed by entering into the reader the feed's URI or by clicking a feed icon in a web browser that initiates the subscription process. The RSS reader checks the user's subscribed feeds regularly for new work, downloads any updates that it finds, and provides a user interface to monitor and read the feeds. RSS allows users to avoid manually inspecting all of the websites they are interested in, and instead subscribe to websites such that all new content is pushed onto their browsers when it becomes available.

IM (Instant Messaging)

Instant messaging (IM) is a form of real-time direct text-based communication between two or more people using personal computers or other devices, along with shared clients. The user's text is conveyed over a network, such as the Internet. More advanced instant messaging software clients also allow enhanced modes of communication, such as live voice or video calling.

Endcap

A display for a product placed at the end of an aisle. It is perceived to give a brand a competitive advantage. It is often available for lease to a manufacturer in a retail environment.

Portable Computing Device

Mobile computing is a form of human-computer interaction by which a computer is expected to be transported during normal usage. Mobile computing has three aspects: mobile communication, mobile hardware, and mobile software. The first aspect addresses communication issues in ad-hoc and infrastructure networks as well as communication properties, protocols, data formats and concrete technologies. The second aspect is on the hardware, e.g., mobile devices or device components. The third aspect deals with the characteristics and requirements of mobile applications.

Many types of mobile computers have been introduced since the 1990s including the:

Wearable computer
Personal digital assistant/enterprise digital assistant
Smartphone
Carputer
Ultra-Mobile PC
Tablet computer

SUMMARY OF THE INVENTION

The present invention is intended to provide deterrence for theft at grocery stores, retail stores, or any similar store where high value general merchandise items are more often stolen and are the cause of the highest value of loss to the store. A system that detects theft, activates the alarm conditions of a camera surveillance system, and provides notification to security personnel provides deterrence to crime. In the case where there is a robbery, the system provides the capability for law enforcement to quickly identify the perpetrator, and in the case of repetitive theft, the same person stealing from the same store on multiple occasions, provides evidence for law enforcement to arrest and prosecute the perpetrator.

One object of the present invention is to provide a method of detection of a theft in progress as any stolen item, typically a high cost or high rate of theft item, is leaving the store exit, or unauthorized area.

Another object of the present invention is to send a signal to an existing camera surveillance system to activate the alarm condition in such camera surveillance system and provide immediate information to store security and law enforcement.

Another object of the present invention is to report all of the items being stolen by reading the RFID tags on every item leaving the store.

Another object of the present invention is to provide notification to store personnel that a theft has occurred so that it can be reported to law enforcement.

Another object of the present invention is to provide a video file of the theft to store security and to law enforcement such that the perpetrator can be identified, caught, watched for multiple thefts, and have evidence for prosecution.

Another object of this invention is to extract digital still pictures from the video clip to send to the store manager or security personnel so there is an immediate picture received to quickly identify the perpetrator.

Another object of this invention is to optionally activate an audible alarm signal after the articles are removed from the smart shelf or zone; this will be the earliest that an audible alert has been able to be activated in a retail environment, and will act as a deterrent to organized retail crime or theft as the perpetrators are far from the store exit, and will be able to claim it was an accident, thus stopping the organized retail crime or theft before it is finished.

Another object of this invention is to optionally provide a monitor at the store exit which will list the items that have not been paid for along with live streaming video of the person leaving with the items with any message pre-programmed by the system administrator displayed on the monitor; the purpose of this option is also to provide deterrence to future thefts.

Another object of the present invention is to allow store personnel to affix RFID tags to any item that is considered to be of high value of has a high likelihood of being stolen.

BRIEF DESCRIPTION OF THE SEVERAL VIEWS OF THE DRAWINGS

The above and other objects, features, and advantages of the present invention are further described in the detailed description which follows, with reference to the drawings by way of non-limiting exemplary embodiments of the present invention, wherein like reference numerals represent similar parts of the present invention throughout the several views and wherein.

DETAILED DESCRIPTION OF THE INVENTION

Figure 1:
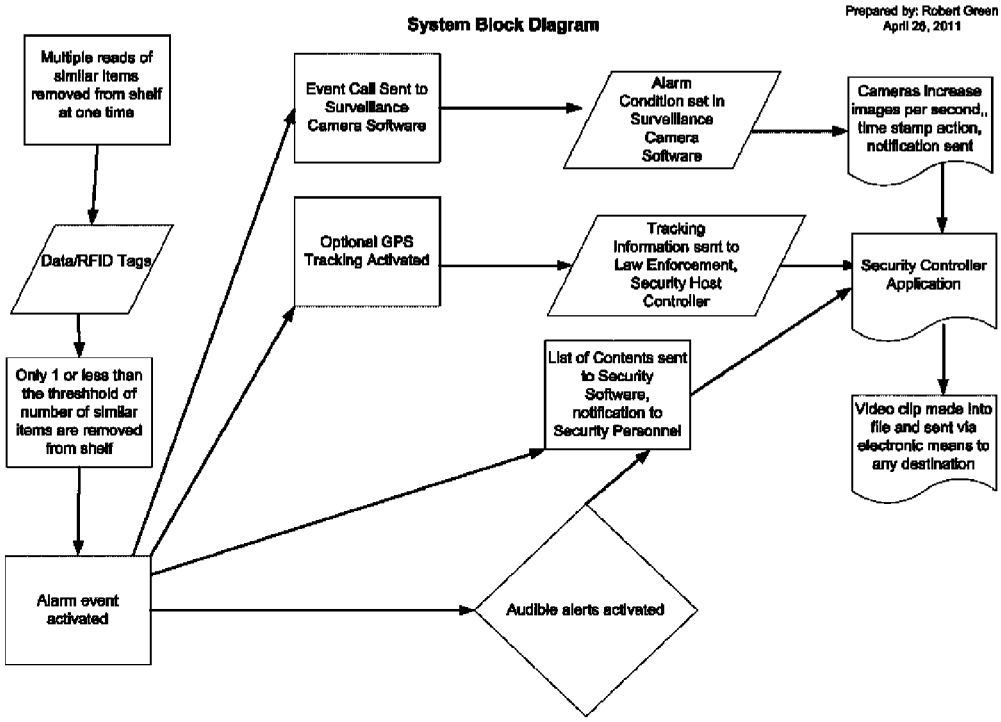
FIG. 1 is a block diagram showing the system process.
Figure 2:
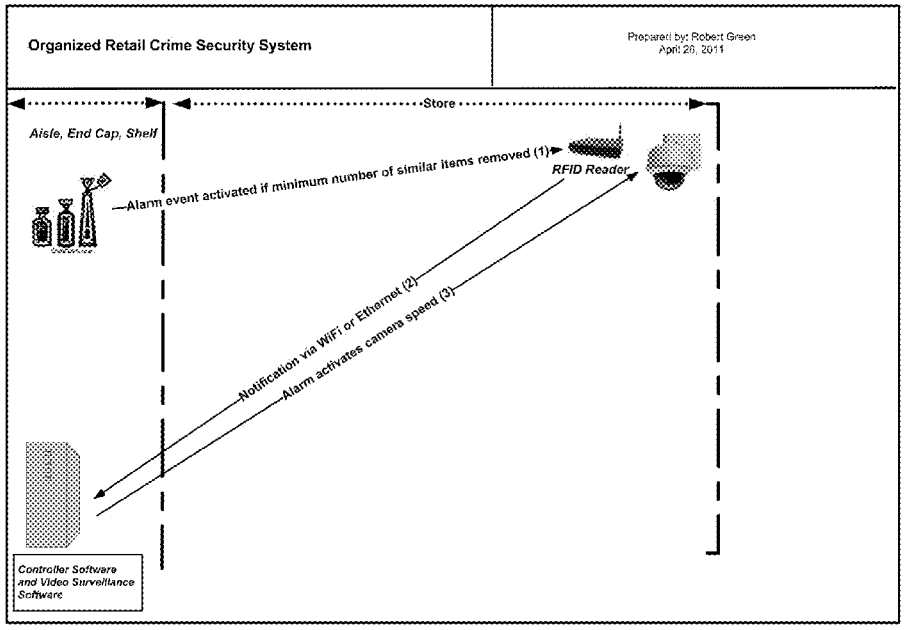
FIG. 2 is an overall view of the local store portion of the security and communications system when multiple of the same items are removed from a monitored aisle or shelf, the video surveillance system and creation of a video file and notification of the alarm to any pre-determined location.
Figure 3:
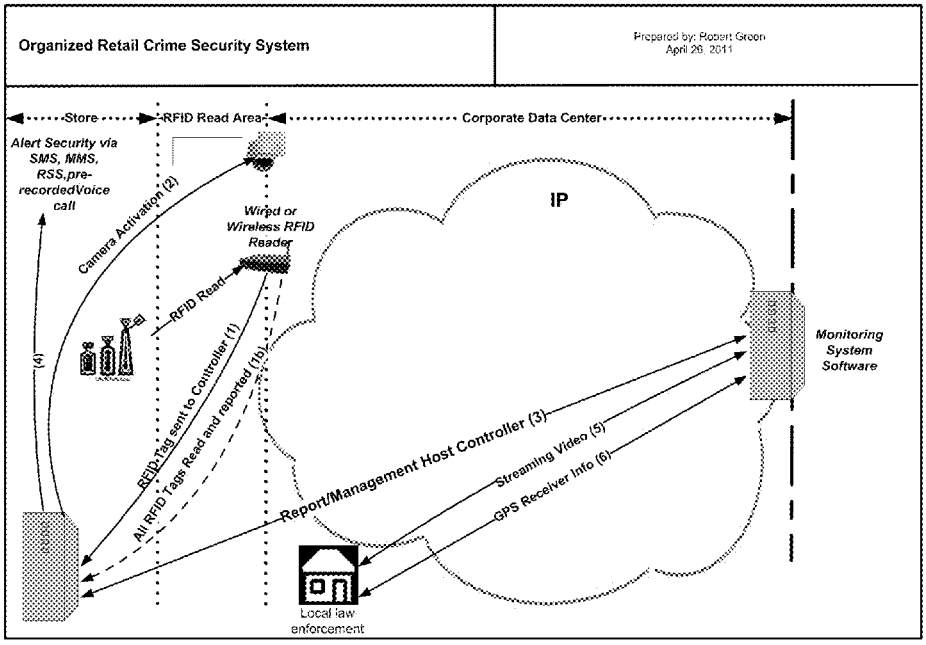
FIG. 3 is a diagram of the local store security system that shows how multiple items removed from a shelf or aisle creates an alarm event, sends alert messages, and activates the camera surveillance system.
Figure 4:
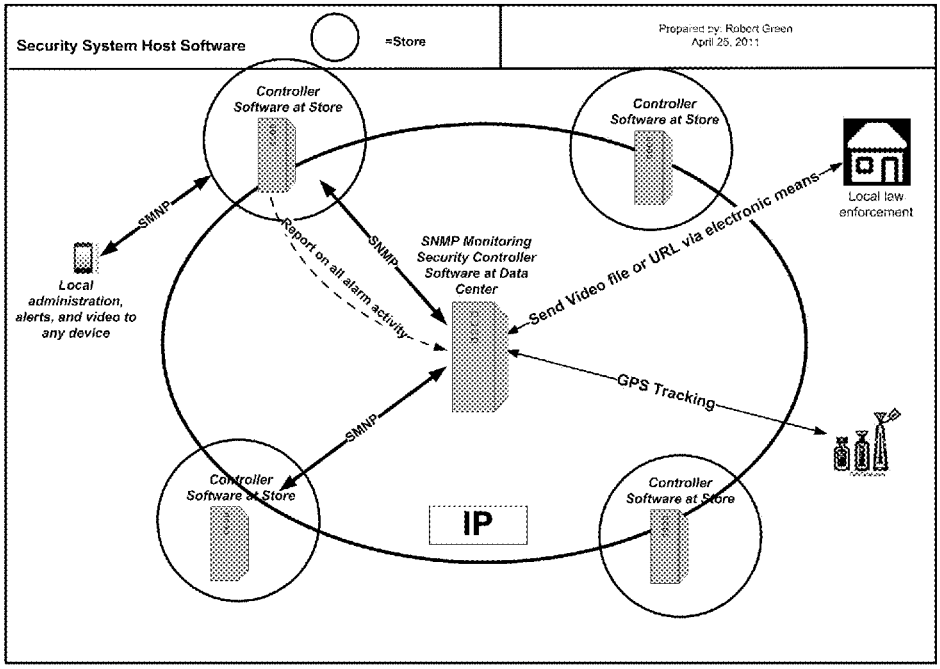
FIG. 4 is a diagram of the entire security and communications system including how each store is managed from a data center via an SNMP monitoring program, and how an individual store operates and interfaces with the master host controller software.
Figure 5:
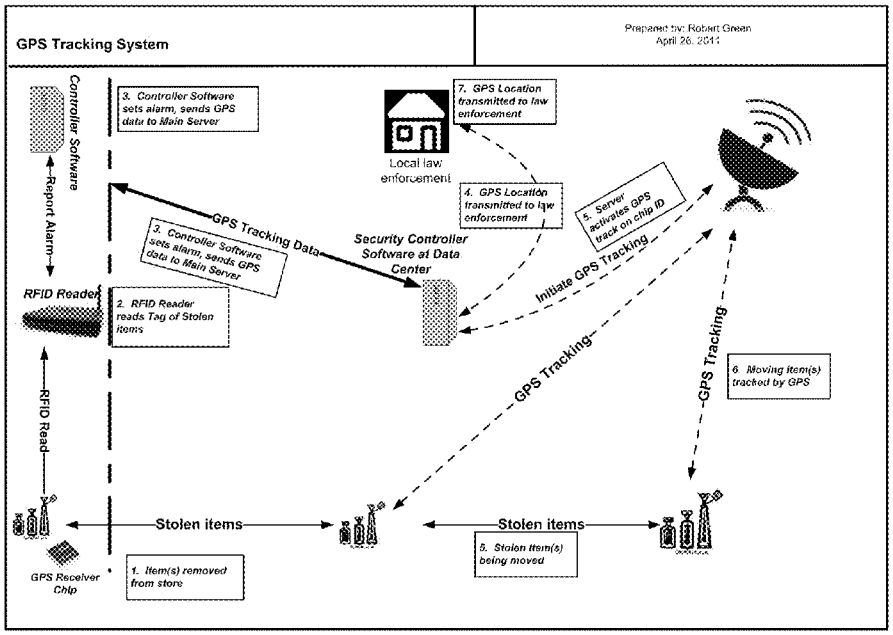
FIG. 5 is a diagram of the GPS tracking system is a GPS receiver is placed on a high theft item that is stolen.

Organized Retail Crime is an ever present concern of the retail industry in stores such as grocery stores, pharmacies, or general merchandise retail stores. Of particular concern are items that are of higher value and have a higher rate of theft, thereby contributing a higher percentage of the overall loss amount to the store. This invention will have a passive RFID or NFC (Near Field Communications) chip affixed to high cost or high theft items at the store or at the manufacturer. Many retail items have an RFID tag affixed to the container, and many items do not; this invention provides Organized Retail Crime and theft detection and security for all items by allowing the store personnel to affix RFID tags to any desired items that are currently not tagged by the manufacturer.

Although the detailed description herein contains many specifics for the purposes of illustration, anyone of ordinary skill in the art will appreciate that many variations and alterations to the following details are within the scope of the embodiments described herein. Thus, the following illustrative embodiments are set forth without any loss of generality to, and without imposing limitations upon, the claimed invention.

A fixed RFID reader and/or RFID antenna or RFID smart shelf is placed at each aisle or zone where high theft items are stocked. The distance of the RFID antenna at each zone will be set so that it will accurately read the RFID tags at an approximate distance of 2-3 feet; however, this distance is programmable by the controller software. Depending on the types of items being monitored, the software will set an alarm condition based on the number of similar items removed at one time, for example 5 or more of a similar item. The parameter for the number of items read to activate the alarm is set in the security controller software and may be customized to each aisle or zone being monitored, or even to each particular item being monitored.

Since all items that have an RFID tag are supposed to be paid for at a checkout location and thus deactivated, a positive RFID tag reading is presumed to be a theft, which will later be confirmed via surveillance video. A positive tag reading of the general merchandise items is sent from the fixed RFID reader to the controller software via Ethernet connection or any type of wireless network. The controller software then sends an event notification to the surveillance video software which sets an alarm condition. The alarm condition in the surveillance video software increases the shutter speed of the cameras located at the zone of the Organized Retail Crime and theft and the exit doors to collect higher definition images, if this feature is available in the existing video surveillance system; one or multiple cameras may be put in alarm status. The video surveillance software will keep this alarm condition for a set amount of time which is programmable by the controller software, will time stamp the alarm condition, and will send a notification to the controller software, which will send a notification of theft to one or more of several destinations: host controller software run at a corporate data center or run at a hosting security company, local security personnel via, SMS, MMS, RSS, IM, paging, pre-recorded voice call, or screen splash or pop up in a mobile device, or any other preferred method of notification.

Immediately after the RFID tag read of the general merchandise item or multiple items, the tag information is sent via wireless or wired communications to the controller software, which will include this information with the message notification.

It is recommended in this system that the user of this invention either use existing surveillance cameras or install additional surveillance cameras such that said cameras will continue to record digital images of the store exit and surrounding area in order to aid law enforcement with additional evidence such as automobile identification of the person who perpetrated the theft.

A recorded video clip file, or still images, or a URL to link to a web site to view the video clip file or still images, will be sent via electronic means to any pre-determined law enforcement office or store security personnel.

Another aspect is to transmit live video as it is recording via video streaming technology such as RTSP, or a URL to link to a web site to view the live streaming video by electronic means, including but not limited to, SMS, MMS, RSS, IM, or email, to store security personnel, security controller software run at corporate data center or hosted by security company, or to pre-determined law enforcement offices.

A security controller application is run at a data center that manages each store location, and uses the SNMP open standard for managing devices on an IP network. The systems administrator at the data center have ultimate control of each installed system and will set user rights and notifications of each store, and determine if anyone at a specific store shall have systems administrator rights into the security system.

Another aspect of this invention is to optionally activate an audible alarm signal as the stolen articles pass through the door exit to alert store personnel and provide deterrence to future thefts. The length and type of signal will be set by programmable option in the controller software. An audible alarm signal may also be activated at the zone or aisle when the pre-determined number of multiple items are removed from the shelf.

Another aspect of this invention is to optionally provide a monitor at the store exit which will list the items that have not been paid for along with live streaming video of the person leaving with the items with an optional message pre-programmed by the system administrator in the security controller software which will be displayed on the monitor; the purpose of this option is also to provide deterrence to future Organized Retail Crime and thefts.

In addition, fixed RFID readers are placed on the proximate door areas (exit/entrance) of a store that will read all RFID tag information upon detection of an RFID tag identifying any general merchandise item via short range connection, and transmit that information to a local access point via longer range wired Wi-Fi technology, which further activates an existing camera surveillance system, and transmits the information to monitoring software located at a data center. This method and system is designed to promote a major deterrence to prospective perpetrators of theft of store items (shoplifting) and in the case of Organized Retail Crime and theft, to provide notification and video evidence to security personnel and optionally to any law enforcement office.

The GPS option can be used on high cost high theft items that are of the right size and packaging such that the GPS receiver can be concealed in the packaging.

Another embodiment of the invention is the use of an application, or applet or a mobile or portable cellular or computing device wherein the mobile device user has remote access to the security software controller and can use any function of the security controller as if the user is using the security software controller at a locally connected computer.

What is claimed is:

1. An organized retail theft detection security system capable of monitoring removal of general merchandise items from a store environment, where the system is configured to monitor within a store using RFID tag information, where the system is configured to be aware of the removal of each registered general merchandise item as it is taken off a shelf, that is an RFID enabled smart shelf, indicating a potential large organized retail theft is occurring when 2 or more items are removed within a programmed range of time, where the components of the organized retail crime or theft detection security system comprise of: general merchandise items each with a passive RFID tags affixed on the inside or outside anywhere on the item or packaging; a fixed or mobile RFID reader; and RFID or Near Field Communication antennas enabled with wired or wireless (Wi-Fi) communications that provides registered RFID tag information to a local or hosted security software application; a camera surveillance system that is activated by a security controller software, whereby the security controller software transmits a notification message to pre-determined security personnel, main controller software at corporate data center or hosted security company via, SMS, MMS, RSS, IM, paging, or pre-recorded voice call, or screen splash or pop up on a mobile device, and whereby the RFID tag information is sent via any electronic means to pre-determined security personnel or store management, main controller software at corporate data center or hosted security company via an electronic means, and whereby a video clip of the event, or URL with a link to a web site to view the video clip beginning at a pre-determined time prior to the RFID reading and continuing to a pre-set time after the reading, is sent to security personnel, main controller software at corporate data center or hosted security company via MMS, RSS, IM, and whereby still digital photo images are extracted from the video clip and sent to one or multiple recipients using mobile devices via MMS, RSS, IM, to one or more recipients for immediate identification of person(s) who has removed items from store aisle that is being monitored; wherein the security software application causes the camera surveillance system to go into an alarm condition where a time stamp is set and camera speed is increased to higher resolution imaging if that feature is available; and where any number of available cameras can be set in an alarm condition, based on parameters set by the systems administrator comprising the total number of items taken off one shelf within a predetermined time period indicative of a theft in progress.

2. The security system as in claim 1, wherein the alarm notification parameters and conditions can be set in the security software controller by authorized store personnel via a GUI (Graphical User Interface); and whereby the parameters and conditions comprises: the total number of items removed from a particular aisle, area, shelf, or cabinet, or the total number the same or similar items of a logical group removed from a particular aisle, area, shelf, or cabinet.

3. The security system as in claim 1, wherein the RFID smart shelf, comprises: an RFID reader and multiple RFID antennas, is mounted or placed behind or near any shelf that contains items that the security systems administrator determines to be high theft items.

4. The security system as in claim 1, wherein one or more additional RFID readers are placed in areas or zones where store merchandise items are not allowed; and where such RFID readers can activate the alarm system by its own unique set of parameters set in the security software controller application.

5. The security system as in claim 1, wherein the RFID reader transmits the tag information of general merchandise items via wired or wireless network to a security software application.

6. The security system as in claim 1, wherein the notification of presumed theft is sent to store security personnel via an electronic means comprising: SMS, MMS, RSS, IM, paging, pre-recorded voice call, or screen splash or pop up on a mobile device; and further such notification is transmitted via the internet (IP) to the main security controller software at the corporate data center or hosted by a security company, and optionally where such notification is sent to any pre-determined law enforcement office via an desired electronic means comprising SMS, MMS, RSS, IM, or pre-recorded voice call.

7. The security system as in claim 1, wherein the video clip is created by the camera surveillance system beginning a pre-programmed length of time prior to the RFID reading of the general merchandise items and continuing to a pre-programmed length of time after the RFID reading.

8. The security system as in claim 1, wherein the a video clip, or a URL to link to a web site to view the video file, is transmitted via electronic means, which include video streaming technology, to a recipient including via electronic means comprising: MMS, RSS, IM, or to a mobile device remote access application or applet software, to store security personnel or pre-determined law enforcement offices using a portable electronic computing device using video streaming technology, security controller software run at corporate data center or hosted by security company.

9. The security system as in claim 1, wherein the security software application activates an audible signal located at the proximate area of the store shelf that is being monitored, the store exits, or over a public address system, where the duration, volume, and type of signal may be programmed in the security software controller.

10. The security system as in claim 1, wherein the security controller software application can activate an event and alarm in any existing camera surveillance system using camera, or number of available cameras, or photographic technology comprising: still images, streaming video, CCTV; and extracting desired data to digitally record and write a file to a disk; or use streaming technology comprising RTSP to send such recorded digital data to a portable computing electronic device.

11. The security system as in claim 1, wherein in the security software application the alarm notification parameters and conditions can be set in the security software controller by authorized store personnel via a GUI (Graphical User Interface); and whereby the parameters comprise of the destination electronic addresses of portable device or portable electronic computing devices, and number and location of cameras put into an alarm condition, and the number of items removed from a monitored shelf or area that activated the alarm.

12. The security system as in claim 1, wherein to deter future thefts a display monitor is placed at the proximate area of the store exit which will list unpaid for items along with live streaming video of the person leaving with the items with an optional message pre-programmed by the system administrator in the security controller software which will be displayed on the monitor.

13. The security system as in claim 1, wherein an application, or applet, is used on a portable electronic computing device, that allows the authorized user access to the controller software to view status, set alert, view an camera, change direction of camera, and run a system test to verify all pieces of the system are working properly.

14. The security system as in claim 13, wherein a user who has authorized access to the security controller via locally networked computer or a portable electronic computing device can activate a search feature in the security controller that will search the history of stored video files on the video server using unstructured data search to find and display video clips that match a selected video clip or image by the user.

15. The application, or applet, as in claim 13, which is operating on a portable electronic computing device, wherein the user of such application can activate the alarm via touch screen, and where such alarm will automatically send an alert message to all other mobile or portable devices defined in the security software controller in which said devices have the same application or applet installed.

16. The system as in claim 6, wherein alert messages and video clips are sent a destination device with pre-programmed phone numbers or network addresses to law enforcement offices.

* * * * *